US011621521B2

(12) United States Patent
Huang et al.

(10) Patent No.: US 11,621,521 B2
(45) Date of Patent: Apr. 4, 2023

(54) PLUG FIXING STRUCTURE AND ELECTRONIC DEVICE WITH PLUG PULL-OUT PREVENTING FUNCTION

(71) Applicant: QISDA CORPORATION, Taoyuan (TW)

(72) Inventors: Cheng-Chih Huang, Taoyuan (TW); Yi-Ting Lee, Kaohsiung (TW)

(73) Assignee: Qisda Corporation, Taoyuan (TW)

( * ) Notice: Subject to any disclaimer, the term of this patent is extended or adjusted under 35 U.S.C. 154(b) by 79 days.

(21) Appl. No.: 17/229,886

(22) Filed: Apr. 14, 2021

(65) Prior Publication Data

US 2022/0190517 A1 Jun. 16, 2022

(30) Foreign Application Priority Data

Dec. 11, 2020 (CN) ..... 202011456014.6

(51) Int. Cl.
*H01R 13/62* (2006.01)
*H01R 13/627* (2006.01)
*H01R 103/00* (2006.01)
*H01R 24/20* (2011.01)

(52) U.S. Cl.
CPC ..... *H01R 13/6275* (2013.01); *H01R 24/20* (2013.01); *H01R 2103/00* (2013.01)

(58) Field of Classification Search
CPC ..... H01R 13/639; H01R 13/629; H01R 13/6275; H01R 13/502; H01R 13/6397; H01R 13/6395; H01R 13/6273
See application file for complete search history.

(56) References Cited

U.S. PATENT DOCUMENTS

| | | | | |
|---|---|---|---|---|
| 8,758,034 | B1 * | 6/2014 | Shotey | H01R 13/701 439/140 |
| 11,322,890 | B2 * | 5/2022 | Cyzen | H01R 27/02 |
| 11,424,575 | B2 * | 8/2022 | Wan | H01R 13/42 |
| 2007/0141886 | A1 * | 6/2007 | Hammer | H01R 13/6392 439/266 |
| 2013/0183855 | A1 * | 7/2013 | Warner | H01R 13/6395 439/536 |
| 2017/0214201 | A1 * | 7/2017 | Armstrong | H02G 3/14 |
| 2018/0083387 | A1 * | 3/2018 | Preuss | H01R 13/6275 |
| 2018/0342837 | A1 * | 11/2018 | Long | H01R 13/6395 |
| 2020/0244019 | A1 * | 7/2020 | Cyzen | H01R 13/6392 |
| 2020/0328559 | A1 * | 10/2020 | Cannon | H01R 13/6395 |

* cited by examiner

*Primary Examiner* — Truc T Nguyen

(57) ABSTRACT

A plug fixing structure is applied to fixing a power plug inserted into a power socket of an electronic device. The power plug has a plug portion and a main body portion. A first engaging structure is formed on an outer periphery of the power socket. The plug fixing structure includes a sleeve casing jacketing the main body portion to expose the plug portion and a first resilient arm having a first arm portion and a first front hook. The first arm portion protrudes from an outer surface of the sleeve casing. The first front hook extends from the first arm portion toward the first engaging structure. The first front hook is engaged with the first engaging structure when the plug portion is inserted into the power socket along a first axis, so as to constrain movement of the power plug along the first axis relative to the power socket.

15 Claims, 6 Drawing Sheets

PLUG FIXING STRUCTURE AND ELECTRONIC DEVICE WITH PLUG PULL-OUT PREVENTING FUNCTION

BACKGROUND OF THE INVENTION

1. Field of the Invention

The present invention relates to a plug fixing structure and an electronic device with a plug pull-out preventing function, and more specifically, to a plug fixing structure utilizing an resilient arm to be engaged with an engaging structure of a power socket and an electronic device with a plug pull-out preventing function.

2. Description of the Prior Art

In general, a power socket for power transmission is disposed at a side of an electronic device (e.g. a projector), such as an AC socket. In the practical application, a power plug of a power cable of an electronic device is a universal plug (USA/EU/JP) and allows that a user could insert the power plug into the power socket of the electronic device by himself.

However, in this design, the power plug could be disengaged from the power socket accidentally due to wrong operations by the user or an external force pulling the power cable (e.g. the user pulls the power cable accidentally), so as to cause sudden power off or even short circuit of the electronic device.

SUMMARY OF THE INVENTION

The present invention provides a plug fixing structure applied to fixing a power plug inserted into a power socket of an electronic device. The power plug has a plug portion and a main body portion. At least one first engaging structure is formed on an outer periphery of the power socket. The plug fixing structure includes a sleeve casing and a first resilient arm. The sleeve casing jackets the main body portion to expose the plug portion. The first resilient arm has a first arm portion and a first front hook. The first arm portion protrudes outward from an outer surface of the sleeve casing. The first front hook extends from the first arm portion toward the first engaging structure. The first front hook is engaged with the first engaging structure when the plug portion is inserted into the power socket along a first axis, for constraining movement of the power plug along the first axis relative to the power socket.

The present invention further provides an electronic device having a plug pull-out preventing function. The electronic device includes a device body, a power plug, and a plug fixing structure. The device body has a power socket. At least one first engaging structure is formed on an outer periphery of the power socket. The power plug has a plug portion and a main body portion. The plug fixing structure includes a sleeve casing and a first resilient arm. The sleeve casing jackets the main body portion to expose the plug portion. The first resilient arm has a first arm portion and a first front hook. The first arm portion protrudes outward from an outer surface of the sleeve casing. The first front hook extends from the first arm portion toward the first engaging structure. The first front hook is engaged with the first engaging structure when the plug portion is inserted into the power socket along a first axis, for constraining movement of the power plug along the first axis relative to the power socket.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
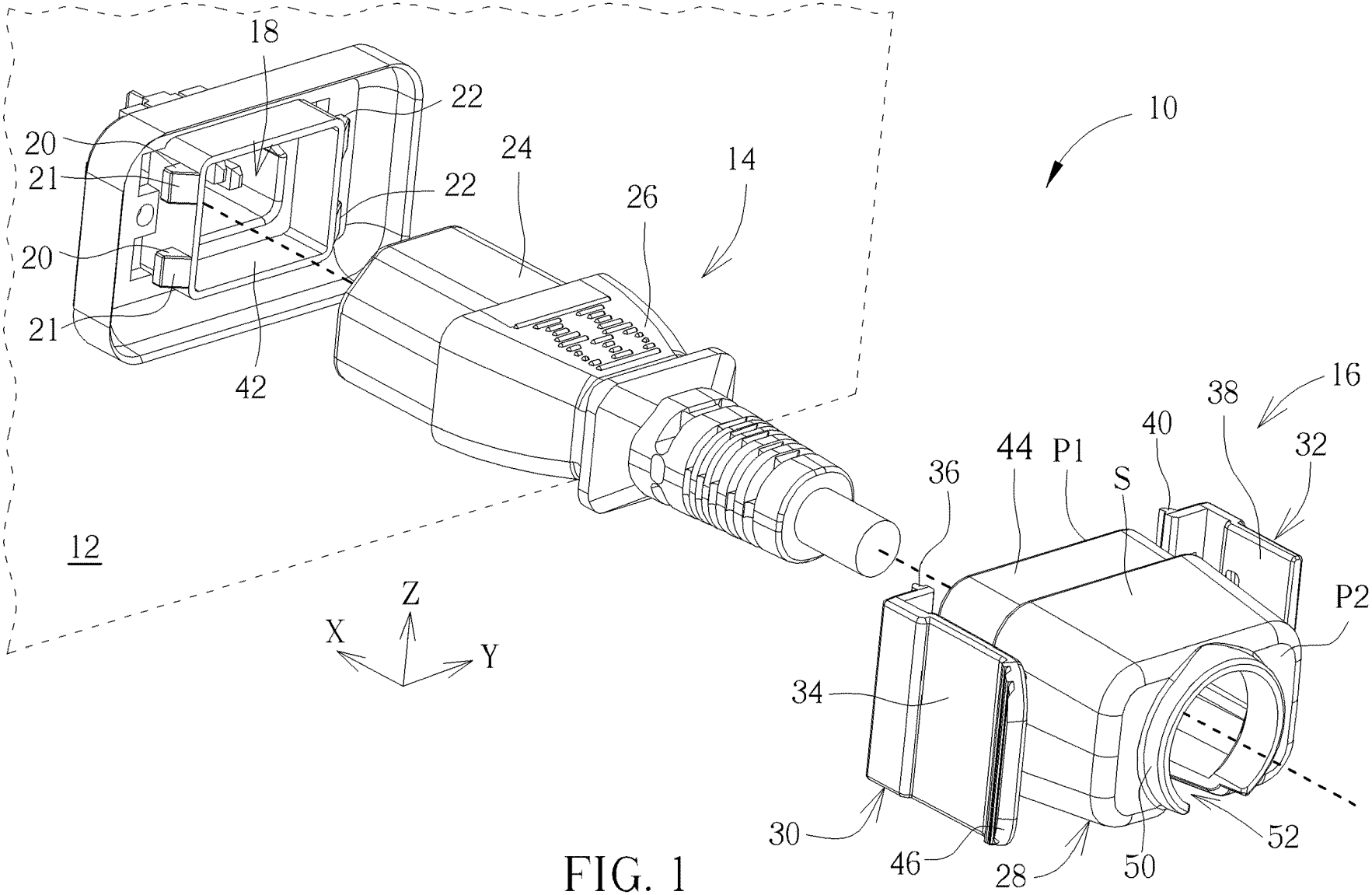
FIG. 1 is a partial exploded diagram of an electronic device according to an embodiment of the present invention.

Please refer to FIG. 1, which is a partial exploded diagram of an electronic device 10 according to an embodiment of the present invention. For clearly showing the plug pull-out preventing design of the electronic device 10, related components (e.g. a casing, internal electronic components, etc.) of a device body 12 except for a power socket 18 are briefly depicted by dotted lines in FIG. 1. As shown in FIG. 1, the electronic device 10 could be a conventional electronic apparatus having a power socket configuration (e.g. a projector or a desktop LCD (Liquid Crystal Display) monitor, but not limited thereto) and includes the device body 12, a power plug 14, and a plug fixing structure 16. The device body 12 has the power socket 18, and at least one first engaging structure 20 and at least one second engaging structure 22 (two first engaging structures 20 and two second engaging structures 22 shown in FIG. 1, but not limited thereto) are formed on an outer periphery of the power socket 18. The power plug 14 has a plug portion 24 and a main body portion 26. The plug fixing structure 16 includes a sleeve casing 28, a first resilient arm 30, and a second resilient arm 32. The sleeve casing 28 jackets the main body portion 26 to expose the plug portion 24. The first resilient arm 30 has a first arm portion 34 and a first front hook 36, and the second resilient arm 32 has a second arm portion 38 and a second front hook 40. The first arm portion 34 and the second arm portion 38 protrude outward from an outer surface S of the sleeve casing 28 respectively. The first front hook 36 extends from the first arm portion 34 toward the first engaging structure 20, and the second front hook 40 extends from the second arm portion 38 toward the second engaging structure 22. Accordingly, when the plug portion 24 is inserted into the power socket 18 along a first axis (i.e. an X-axis as shown in FIG. 1), the first front hook 36 is engaged with the first engaging structure 20 and the second front hook 40 is engaged with the second engaging structure 22, so as to constrain movement of the power plug 14 along the first axis relative to the power socket 18. As such, the present invention can prevent accidental disengagement of the plug portion 24 from the power socket 18 due to wrong operations by a user or an external force pulling a power cable.

To be more specific, in this embodiment, the present invention could further adopt a sleeve limiting design. As shown in FIG. 1, an outer ring sleeve 42 is formed around the outer periphery of the power socket 18, and a limiting casing section 44 is formed at an end portion P1 of the sleeve casing 28 close to the plug portion 24 and contracts inward relative to the outer ring sleeve 42. Accordingly, when the plug portion 24 is inserted into the power socket 18, the limiting casing section 44 can be sandwiched between the outer ring sleeve 42 of the power socket 18 and the main body portion 26 of the power plug 14, so as to constrain movement of the power plug 14 along a second axis and a third axis relative to the power socket 18, wherein the second axis could be a Y-axis and the third axis could be a Z-axis as shown in FIG. 1, meaning that the first axis, the second axis, and the third axis are perpendicular to each other.

Furthermore, in this embodiment, the first engaging structure 20 and the second engaging structure 22 could be preferably engaging blocks protruding from the outer ring sleeve 42 to be engaged with the first front hook 36 and the second front hook 40 respectively. For guiding the first front hook 36 and the second front hook 40 to be engaged with the first engaging structure 20 and the second engaging structure 22 smoothly without jamming, as shown in FIG. 1, an inclined surface 21 could be preferably formed on the engaging block. As such, with insertion of the plug portion 24 into the power socket 18 along the first axis, the first front hook 36 and the second front hook 40 can slide along the inclined surfaces 21 on the first engaging structure 20 and the second engaging structure 22 respectively and then move across the first engaging structure 20 and the second engaging structure 22 smoothly, so as to efficiently prevent structural interference or even jamming between the plug fixing structure 16 and the power socket 18.

In the practical application, for helping the user release engagement of the first front hook 30 and the first engaging structure 20 more smoothly, as shown in FIG. 1, the first resilient arm 30 has a pressing sheet 46 extending rearward. In such a manner, when the pressing sheet 46 is pressed by an external force, the first resilient arm 30 can deform outward to make the first front hook 36 disengaged from the first engaging structure 20, so that the user can pull the power plug 14 out of the power socket 18 quickly and effortlessly.

Figure 2:
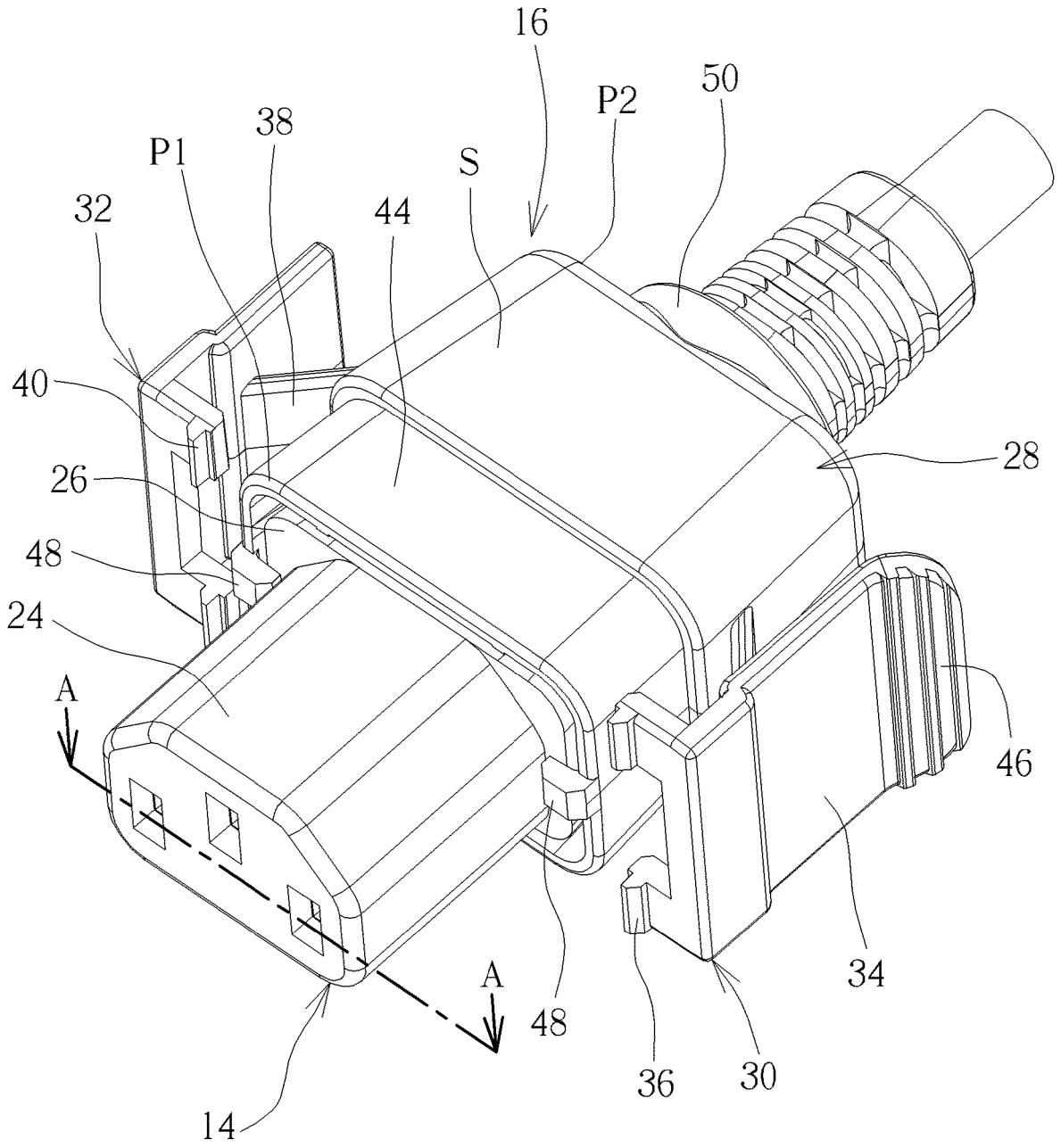
FIG. 2 is a diagram of a sleeve casing in FIG. 1 jacketing a main body portion of a power plug.
Figure 3:
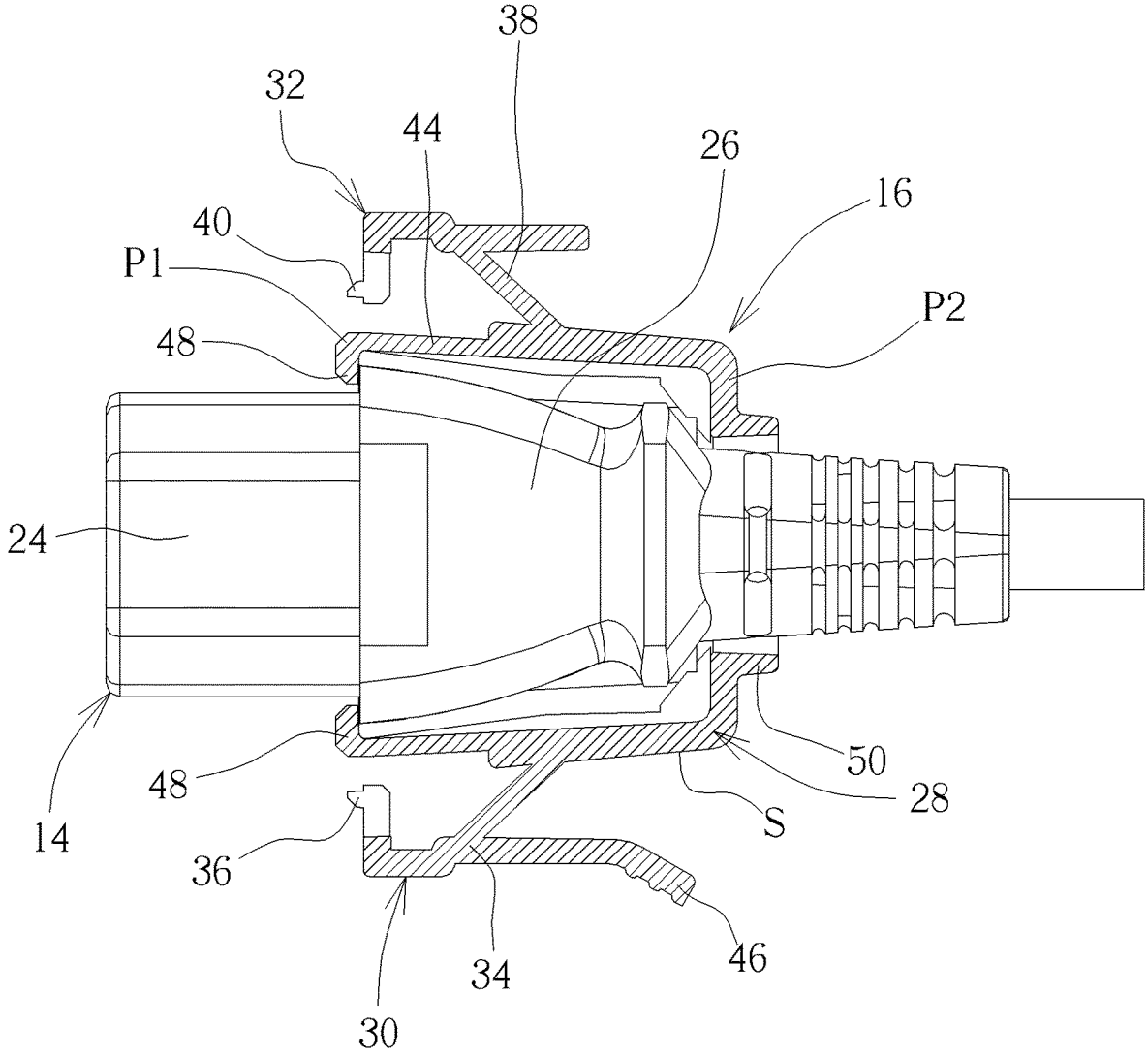
FIG. 3 is a cross-sectional diagram of the power plug having the sleeve casing jacketing thereon along a cross-sectional line A-A.

As for the jacketing design of the sleeve casing 28 and the main body portion 26, it could be as shown in FIG. 2 and FIG. 3. FIG. 2 is a diagram of the sleeve casing 28 in FIG. 1 jacketing the main body portion 26 of the power plug 14. FIG. 3 is a cross-sectional diagram of the power plug 14 having the sleeve casing 28 jacketing thereon along a cross-sectional line A-A. In this embodiment, at least one limiting hook 48 (two shown in FIG. 2, but not limited thereto) is formed at the end portion P1 of the sleeve casing 28 close to the plug portion 24, and a ring base 50 contracts inward from an end portion P2 of the sleeve casing 28 away from the plug portion 24. Accordingly, when the sleeve casing 28 jackets the main body portion 26, the limiting hook 48 is engaged with a front end of the main body portion 26 and the ring base 50 abuts against an rear end of the main body portion 26, so as to make the sleeve casing 28 jacket the main body portion 26 steadily in a front and back clamping manner (as shown in FIG. 3). Furthermore, as shown in FIG. 1, a cut-off slot 52 could be formed on the sleeve casing 28 longitudinally to make a transverse cross-section of the sleeve casing 28 C-shaped, so that the sleeve casing 28 can deform radially (but not limited thereto). As such, the sleeve casing 28 can jacket the main body portion elastically such that the user can perform assembly and disassembly operations of the sleeve casing 28 and the power plug 14 conveniently.

Figure 4:
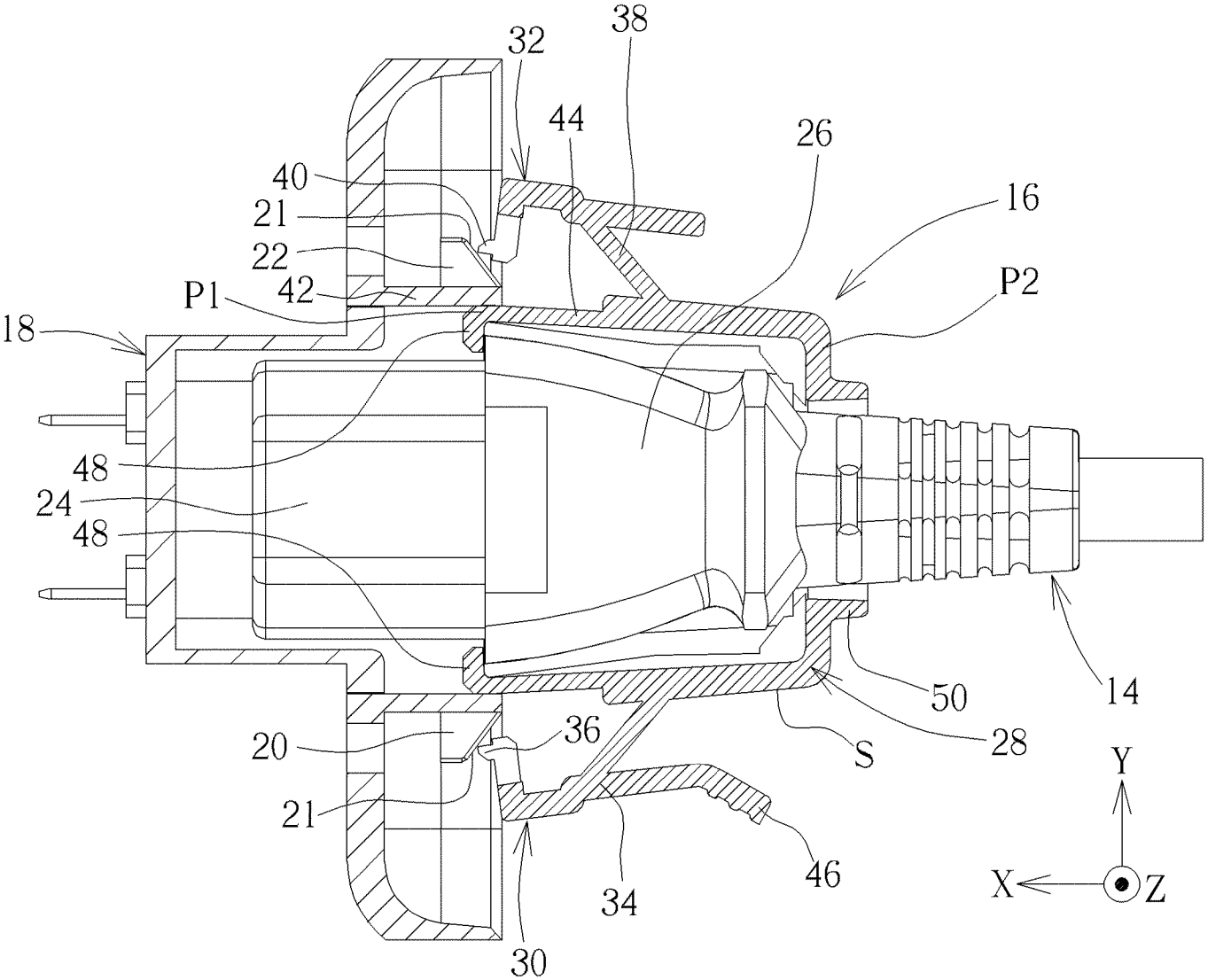
FIG. 4 is a cross-sectional diagram of a first front hook and a second front hook in FIG. 3 abutting against a first engaging structure and a second engaging structure respectively when the power plug is inserted into a power socket along a first axis.
Figure 5:
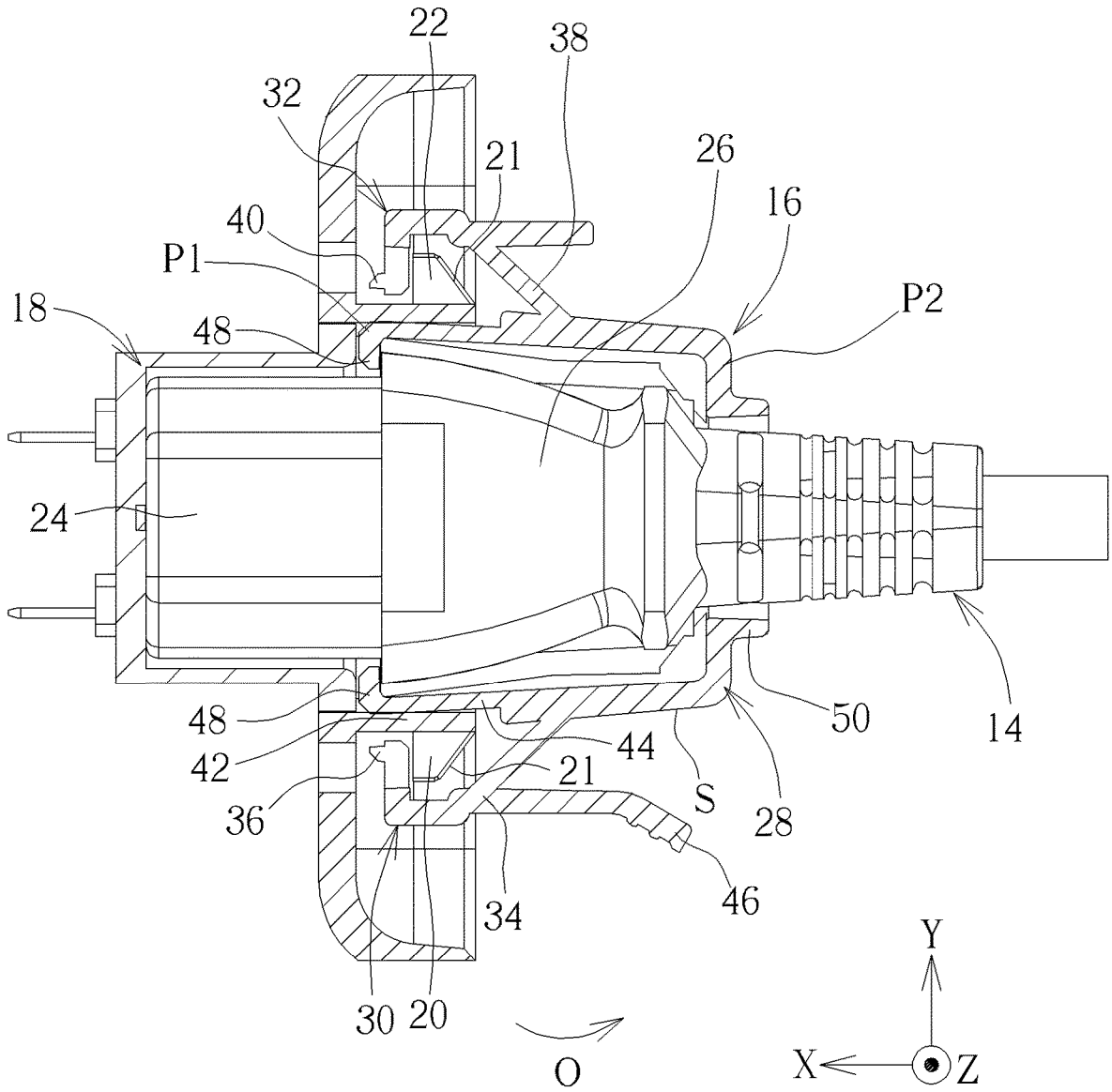
FIG. 5 is a cross-sectional diagram of the first front hook and the second front hook in FIG. 4 being engaged with the first engaging structure and the second engaging structure respectively.

More detailed description for the power plug operation of the electronic device 10 is provided as follows. Please refer to FIG. 4 and FIG. 5. FIG. 4 is a cross-sectional diagram of the first front hook 36 and the second front hook 40 in FIG. 3 abutting against the first engaging structure 20 and the second engaging structure 22 respectively when the power plug 14 is inserted into the power socket 18 along the first axis. FIG. 5 is a cross-sectional diagram of the first front hook 36 and the second front hook 40 in FIG. 4 being engaged with the first engaging structure 20 and the second engaging structure 22 respectively.

As shown in FIG. 4 and FIG. 5, when a user wants to perform the plug insertion operation of the electronic device 10, the user just needs to jacket the sleeve casing 28 on the main body portion 26 of the power plug 14, and then inserts the exposed plug portion 24 into the power socket 18 along the first axis. During this process, with insertion of the plug portion 24 into the power socket 18 along the first axis, the first front hook 36 and the second front hook 40 abut against the first engaging structure 20 and the second engaging structure 22 respectively, and then slide along the inclined surfaces 21 on the first engaging structure 20 and the second engaging structure 22. As such, the first front hook 36 and the second front hook 40 can be biased laterally by the first engaging structure 20 and the second engaging structure 22 to deform outward (as shown in FIG. 4) until the first front hook 36 and the second front hook 40 move across and then are engaged with the first engaging structure 20 and the second engaging structure 22 respectively (as shown in FIG. 5), so as to constrain movement of the power plug 18 along the first axis. At the same time, as mentioned above, the limiting casing section 44 of the sleeve casing 28 can be sandwiched between the outer ring sleeve 42 of the power socket 18 and the main body portion 26 of the power plug 14 (as shown in FIG. 5) with insertion of the plug portion 24 into the power socket 18 along the first axis, so as to constrain movement of the power plug 14 along the second axis and the third axis relative to the power socket 18.

In summary, via the three-axial constraining design that the first front hook 36 and the second front hook 40 are engaged with the first engaging structure 20 and the second engaging structure 22 respectively to constrain movement of the power plug 18 along the first axis and the limiting casing section 44 are sandwiched between the outer ring sleeve 42 and the main body portion 26 to constrain movement of the power plug 18 along the second axis and the third axis, the power plug 14 can be inserted into the power socket 18 steadily so that the electronic device 10 can have a plug pull-out prevention function. In such a manner, the present invention can efficiently solve the prior art problem that the power plug is disengaged from the power socket accidentally due to wrong operations by the user or an external force pulling the power cable (e.g. the user pulls the power cable accidentally) to cause sudden power off or even short circuit of the electronic device. Thus, safety of the electronic device 10 in the power plug operation can be improved greatly.

On the other hand, when the user wants to perform the plug pulling operation of the electronic device 10, the user just needs to grasp the first resilient arm 30 and the second resilient arm 32 with his fingers, and then presses the pressing sheet 46 of the first resilient arm 30 to cause outward deformation of the first resilient arm 30. As such, the first front hook 36 can be disengaged from the first engaging structure 20 with outward deformation of the first resilient arm 30, so that the user can pull the power plug 14 out of the power socket 18 quickly and effortlessly. For example (but not limited thereto), since the first front hook 36 is no longer engaged with the first engaging structure 20 at this time, the user can rotate the power plug 14 to move the first front hook 36 away from the first engaging structure 20 (i.e. in a counterclockwise direction as indicated by an arrow O in FIG. 5), so as to further release engagement of the second front hook 40 and the second engaging structure 22. In such a manner, the user can pull the power plug 14 out of the power socket 18 smoothly for the subsequent plug replacing or re-plugging operation.

It should be mentioned that the second resilient arm, the second engaging structure, the outer ring sleeve, the limiting casing section, the ring base, the limiting hook, the inclined surface, the pressing sheet and the cut-off slot could be omitted selectively for simplifying the structural design of the plug fixing structure of the present invention. For example, in another embodiment, the plug fixing structure could fix the power plug to the power socket only via one-sided engagement of the first front hook of the first resilient arm and the first engaging structure. As for the related description for other derived embodiments (e.g. the user could press the resilient arm directly without the pressing sheet to cause outward deformation of the resilient arm for detaching the front hook of the resilient arm from the engaging structure on the power socket), it could be reasoned by analogy according to the aforesaid embodiments and omitted herein. Furthermore, the first engaging structure and the second engaging structure are not limited to the protruding blocks. That is, all the fixing structural designs for engaging with the first front hook and the second front hook (e.g. the first engaging structure could be a hole structure formed on the outer periphery of the power socket to allow the first front hook to be engaged therewith) could be adopted by the present invention.

Figure 6:
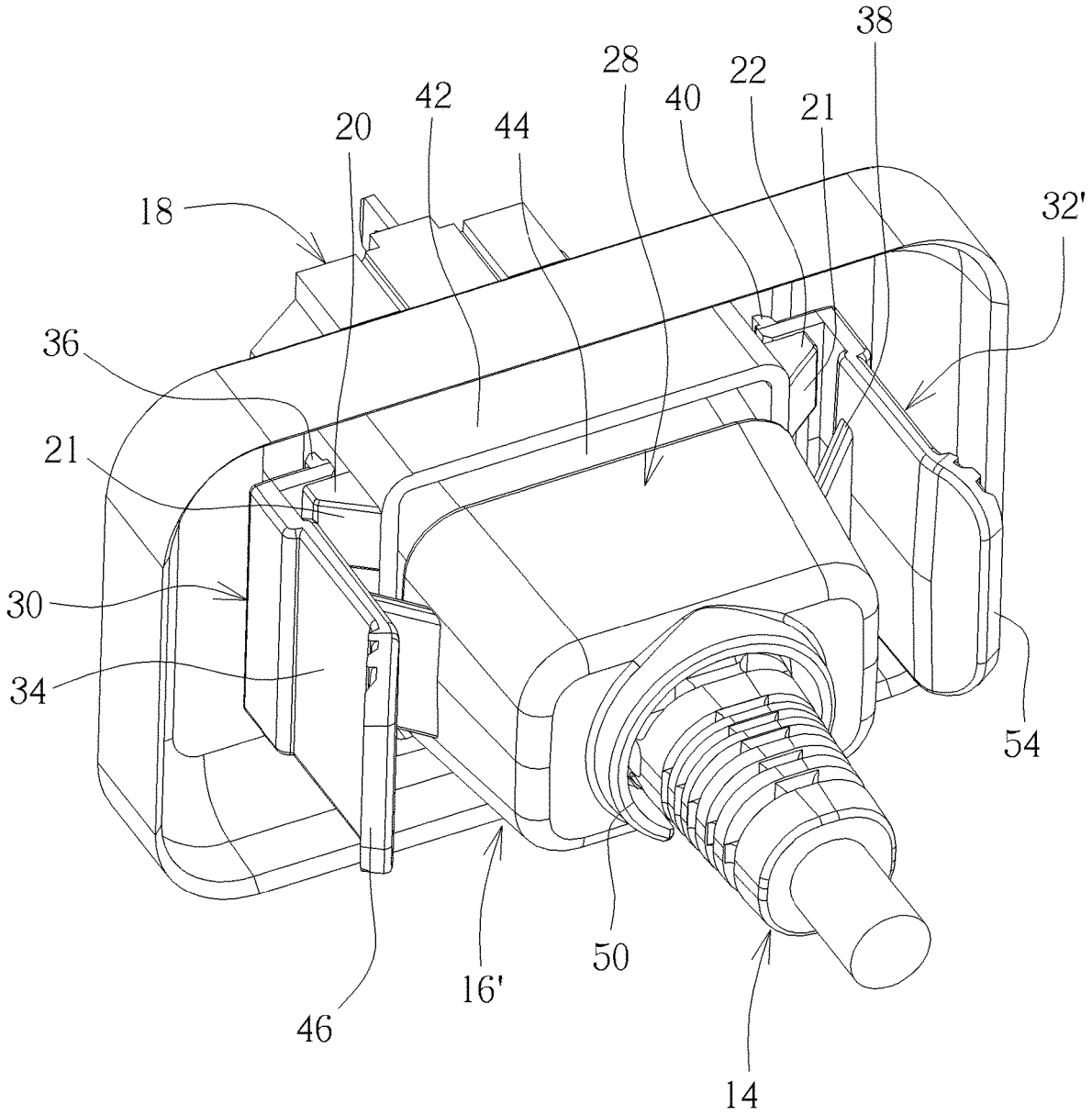
FIG. 6 is a diagram of a plug fixing structure fixing the power plug to the power socket according to another embodiment of the present invention.

Moreover, the pressing sheet design could be applied to the second resilient arm. For example, please refer to FIG. 6, which is a diagram of a plug fixing structure 16' fixing the power plug 14 to the power socket 18 according to another embodiment of the present invention. Components both mentioned in this embodiment and the aforesaid embodiments represent components with similar structures or functions, and the related description is omitted herein. As shown in FIG. 6, the plug fixing structure 16' includes the sleeve casing 28, the first resilient arm 30, and a second resilient arm 32'. A pressing sheet 54 extends rearward from the second resilient arm 32'. Accordingly, when the user wants to perform the plug pulling operation, the user just needs to grasp the first resilient arm 30 and the second resilient arm 32 with his fingers, and then presses the pressing sheet 46 and the pressing sheet 54 to cause outward deformation of the first resilient arm 30 and the second resilient arm 32'. As such, the first front hook 36 and the second front hook 40 can be disengaged from the first engaging structure 20 and the second engaging structure 22 respectively. At this time, since the first front hook 36 and the second front hook 40 are no longer engaged with the first engaging structure 36 and the second engaging structure 40, the user can pull the power plug 14 out of the power socket 18 quickly and effortlessly for the subsequent plug replacing or re-plugging operation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plug fixing structure applied to fixing a power plug inserted into a power socket of an electronic device, the power plug having a plug portion and a main body portion, at least one first engaging structure being formed on an outer periphery of the power socket, an outer ring sleeve being formed around the outer periphery of the power socket, the plug fixing structure comprising:

a sleeve casing jacketing the main body portion to expose the plug portion, a limiting casing section being formed at an end portion of the sleeve casing close to the plug portion and contracting inward relative to the outer ring sleeve; and a first resilient arm having a first arm portion and a first front hook, the first arm portion protruding outward from an outer surface of the sleeve casing, the first front hook extending from the first arm portion toward the first engaging structure, and the first front hook being engaged with the first engaging structure when the plug portion is inserted into the power socket along a first axis, for constraining movement of the power plug along the first axis relative to the power socket;

wherein when the plug portion is inserted into the power socket, the limiting casing section is sandwiched between the outer ring sleeve and the main body portion for constraining movement of the power plug along a second axis and a third axis relative to the power socket, and the first axis, the second axis, and the third axis are perpendicular to each other.

2. The plug fixing structure of claim 1, wherein the first engaging structure is an engaging block protruding from the outer ring sleeve; with insertion of the plug portion into the power socket along the first axis, the first front hook abuts against the engaging block to make the first resilient arm biased laterally by the engaging block to cause outward deformation of the first resilient arm, and then moves across the engaging block to be engaged with the engaging block for constraining movement of the power plug along the first axis.

3. The plug fixing structure of claim 2, wherein an inclined surface is formed on the engaging block; when the first front hook abuts against the engaging block, the first front hook slides along the inclined surface to move across the engaging block with insertion of the plug portion into the power socket along the first axis.

4. The plug fixing structure of claim 1, wherein the first resilient arm has a pressing sheet extending rearward; when the pressing sheet is pressed by an external force, the first resilient arm deforms outward to make the first front hook disengaged from the first engaging structure.

5. The plug fixing structure of claim 1, wherein at least one second engaging structure is formed on the outer periphery of the power socket, and the plug fixing structure further comprises:

a second resilient arm having a second arm portion and a second front hook, the second arm portion protruding outward from the outer surface of the sleeve casing, the second front hook extending from the second arm portion toward the second engaging structure, and the second front hook being engaged with the second engaging structure when the plug portion is inserted into the power socket along the first axis, for constraining movement of the power plug along the first axis relative to the power socket.

6. The plug fixing structure of claim 1, wherein at least one limiting hook is formed at an end portion of the sleeve casing close to the plug portion, and a ring base contracts from an end portion of the sleeve casing away from the plug portion; when the sleeve casing jackets the main body portion, the limiting hook is engaged with a front end of the main body portion and the ring base abuts against an rear end of the main body portion, so as to jacket the sleeve casing on the main body portion in a front and back clamping manner.

7. The plug fixing structure of claim 1, wherein a cut-off slot is formed longitudinally on the sleeve casing to make a transverse cross-section of the sleeve casing C-shaped.

8. An electronic device having a plug pull-out preventing function, the electronic device comprising:

a device body having a power socket, at least one first engaging structure being formed on an outer periphery of the power socket, an outer ring sleeve being formed around the outer periphery of the power socket;

a power plug having a plug portion and a main body portion; and a plug fixing structure comprising:

a sleeve casing jacketing the main body portion to expose the plug portion, a limiting casing section being formed at an end portion of the sleeve casing close to the plug portion and contracting inward relative to the outer ring sleeve; and a first resilient arm having a first arm portion and a first front hook, the first arm portion protruding outward from an outer surface of the sleeve casing, the first front hook extending from the first arm portion toward the first engaging structure, and the first front hook being engaged with the first engaging structure when the plug portion is inserted into the power socket along a first axis, for constraining movement of the power plug along the first axis relative to the power socket;

wherein when the plug portion is inserted into the power socket, the limiting casing section is sandwiched between the outer ring sleeve and the main body portion for constraining movement of the power plug along a second axis and a third axis relative to the power socket, and the first axis, the second axis, and the third axis are perpendicular to each other.

9. The electronic device of claim 8, wherein the first engaging structure is an engaging block protruding from the outer ring sleeve; with insertion of the plug portion into the power socket along the first axis, the first front hook abuts against the engaging block to make the first resilient arm biased laterally by the engaging block to cause outward deformation of the first resilient arm, and then moves across the engaging block to be engaged with the engaging block for constraining movement of the power plug along the first axis.

10. The electronic device of claim 9, wherein an inclined surface is formed on the engaging block; when the first front hook abuts against the engaging block, the first front hook slides along the inclined surface to move across the engaging block with insertion of the plug portion into the power socket along the first axis.

11. The electronic device of claim 8, wherein the first resilient arm has a pressing sheet extending rearward; when the pressing sheet is pressed by an external force, the first resilient arm deforms outward to make the first front hook disengaged from the first engaging structure.

12. The electronic device of claim 8, wherein at least one second engaging structure is formed on the outer periphery of the power socket, and the plug fixing structure further comprises:

a second resilient arm having a second arm portion and a second front hook, the second arm portion protruding outward from the outer surface of the sleeve casing, the second front hook extending from the second arm portion toward the second engaging structure, and the second front hook being engaged with the second engaging structure when the plug portion is inserted into the power socket along the first axis, for constraining movement of the power plug along the first axis relative to the power socket.

13. The electronic device of claim 8, wherein at least one limiting hook is formed at an end portion of the sleeve casing close to the plug portion, and a ring base contracts from an end portion of the sleeve casing away from the plug portion; when the sleeve casing jackets the main body portion, the limiting hook is engaged with a front end of the main body portion and the ring base abuts against an rear end of the main body portion, so as to jacket the sleeve casing on the main body portion in a front and back clamping manner.

14. The electronic device of claim 8, wherein a cut-off slot is formed longitudinally on the sleeve casing to make a transverse cross-section of the sleeve casing C-shaped.

15. A plug fixing structure applied to fixing a power plug inserted into a power socket of an electronic device, the power plug having a plug portion and a main body portion, at least one first engaging structure being formed on an outer periphery of the power socket, the plug fixing structure comprising:

a sleeve casing jacketing the main body portion to expose the plug portion, at least one limiting hook being formed at an end portion of the sleeve casing close to the plug portion, and a ring base contracting from an end portion of the sleeve casing away from the plug portion; and a first resilient arm having a first arm portion and a first front hook, the first arm portion protruding outward from an outer surface of the sleeve casing, the first front hook extending from the first arm portion toward the first engaging structure, and the first front hook being engaged with the first engaging structure when the plug portion is inserted into the power socket along a first axis, for constraining movement of the power plug along the first axis relative to the power socket;

wherein when the sleeve casing jackets the main body portion, the limiting hook is engaged with a front end of the main body portion and the ring base abuts against an rear end of the main body portion, so as to jacket the sleeve casing on the main body portion in a front and back clamping manner.

* * * * *